United States Patent [19]

Ghez et al.

[11] 4,239,586

[45] Dec. 16, 1980

[54] ETCHING OF MULTIPLE HOLES OF UNIFORM SIZE

[75] Inventors: Richard A. Ghez, Millwood; John B. Gunn, Mt. Kisco, both of N.Y.; Robert Hammer, Brookfield Center, Conn.; James A. Van Vechten, Millwood, N.Y.

[73] Assignee: International Business Machines Corporation, Armonk, N.Y.

[21] Appl. No.: 53,490

[22] Filed: Jun. 29, 1979

[51] Int. Cl.[3] ..... H01L 21/306

[52] U.S. Cl. ..... 156/644; 156/654

[58] Field of Search ..... 156/644, 654, 345, 643, 156/646, 647

[56] References Cited

U.S. PATENT DOCUMENTS

| | | | |
|---|---|---|---|
| 3,645,811 | 2/1972 | Davies et al. | 156/345 |
| 3,666,579 | 5/1972 | Dietch | 156/345 |
| 3,724,066 | 4/1973 | Wainer et al. | 29/592 |
| 3,770,533 | 11/1973 | Zwicker | 156/647 |
| 3,921,916 | 11/1975 | Bassous | 346/75 |
| 4,007,464 | 2/1977 | Bassous et al. | 156/644 |
| 4,021,278 | 5/1977 | Hood et al. | 156/626 |
| 4,066,491 | 1/1978 | Ruh et al. | 156/644 |
| 4,155,775 | 5/1979 | Alpaugh et al. | 156/644 |

OTHER PUBLICATIONS

Brunsch et al., "Etching . . .-Hales", IBM Technical Disclosure Bulletin, vol. 19, No. 8, (1/77), pp. 3085-3086.

*Primary Examiner*—Jerome W. Massie
*Attorney, Agent, or Firm*—Alvin J. Riddles

[57] ABSTRACT

Uniform holes with a diameter of the order of 1 micrometer or larger can be formed by an etching operation which employs the combination properties of the surface tension of the etch coupled with a force on the meniscus of the etch in the hole to cause the etching to stop when one hole reaches the proper size and to permit the etching to continue on all other holes until they reach the same size.

6 Claims, 7 Drawing Figures

FIG. 5A
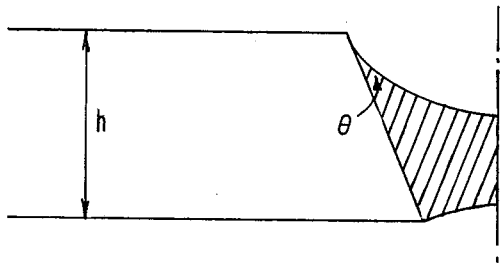
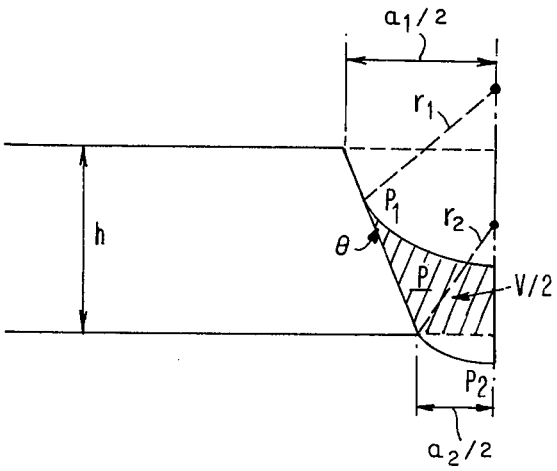
FIG. 5B
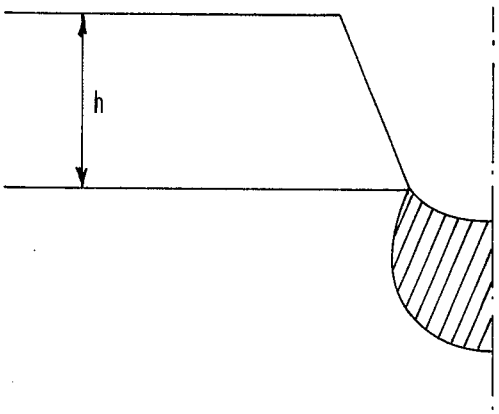
FIG. 5C

ETCHING OF MULTIPLE HOLES OF UNIFORM SIZE

DESCRIPTION

1. Technical Field

The technical field of the invention is that of structures with an array of fine holes which need to be of uniform cross-sectional area. There are a number of applications where such small hole arrays have found usefulness. For example, light amplifiers wherein secondary electrons generated by collisions with the wall of a small passage can be significant; cathode ray tube display shadow masks; various semiconductor via hole formation and various packaging via hole formation; the ink jet printing technique and the formation of permeable membranes. In each of these applications the structure desired is an array of small but precise holes with equal diameters. In such applications the holes are used for aiming or for rejection of objects beyond a certain size and consequently, it is essential to the application to have the hole not only precisely positioned, but also for each hole to be of a precise diameter.

2. Background Art

The sizes are in the range of less than 20 micrometers and the range is beyond most conventional fabrication technology. The technique of etching has been most frequently used in the fabrication of devices of the scale addressed by this invention. In the art, there have been multi-step etching processes such as taught in U.S. Pat. Nos. 3,645,811 and 3,666,579 wherein the size of the hole in the multi-step processing, is measured by the transmissivity of light and the measurement is then used to control subsequent etching steps. Another multi-step process is set forth in U.S. Pat. No. 3,724,066 wherein the size of the hole is measured by a variation in the density of the substrate in which the hole is being placed.

A recent advance in the art as is set forth in U.S. Pat. Nos. 3,921,916 and 3,770,533 and 4,007,464 which employ anisotropic etching and hole shaping by using a crystalline substrate and then preferentially etching along crystallographic planes of the substrate.

Thus far in the art the techniques of uniform small hole fabrication have been confined to multi-step etching operations with complicated in-process controls or in the alternative, to using crystalline substrates and preferential etches.

The invention is a step in the art in that the etching operation is made to be self-limiting at the proper size of the hole.

DESCRIPTION OF THE DRAWING

FIGS. 5A, B and C are schematic illustrations of the mathematical considerations in controlled etching using the apparatus of FIG. 4.

DISCLOSURE OF THE INVENTION

The invention involves a self-limiting etching step in which the surface tension of the etchant and a differential pressure across a meniscus of the etchant extending across the hole operate in combination to interrupt the etching at a certain size hole and to let other holes that have not reached that size continue etching until the proper size is reached. The invention may be practised by relying on the surface tension of the etchant to retain the etchant in the hole until the proper diameter is reached, at which time it runs out; or in the alternative a gas may be forced through the smaller hole openings which when the opening reaches the proper size, the gas bubble forces the etchant away from the critical dimension of the hole.

Best Mode For Carrying Out The Invention

Figure 1:
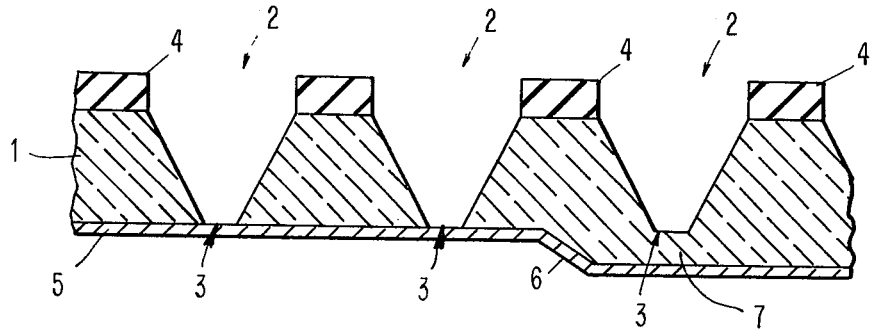
FIGS. 1 and 2 are an illustration of the thickness variation problem encountered in the formation of multiple holes of uniform size in a substrate.
Figure 2:
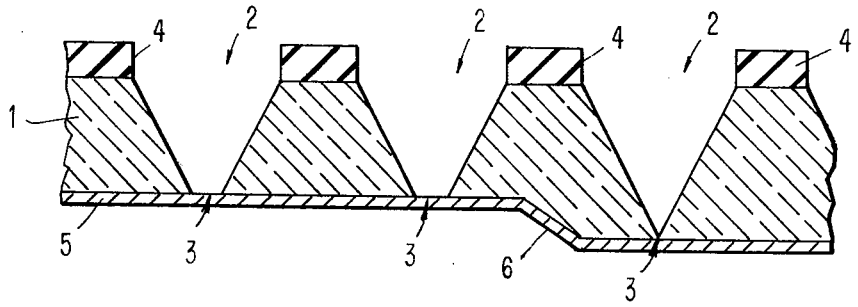

Referring to FIGS. 1 and 2 a cross-sectional illustration is provided of a member in which a plurality of uniformly sized holes are to be placed. In FIG. 1 a substrate 1 is to be provided with a plurality of holes 2 where each hole is to have a uniform cross-section area 3. The holes are shown tapered along the sides as would occur by etching through a mask 4 to a precise cross-sectional area 3 at a resist 5 on the opposite surface. As may be seen in connection with the extreme right hole, a difference in thickness as shown at 6 of the substrate 1 results in the fact that the uniform etching has not caused the hole to break through to the resist 5 and a small web 7 of the original material of the substrate 1 remains.

Referring next to FIG. 2. Were the etching of the structure of FIG. 1 to be continued until the material removed in the most right-hand hole reaches the mask 5, the cross-sectional areas of the hole openings would not be the same. There are other phenomena such as differences in density of the material, or differences in etch rate, such as occurs with various crystallographic planes which also may operate to affect uniformity.

There is a need in the art for a self-limiting etching operation wherein the hole whose diameter has not been etched out to the proper size, can continue etching while the etching operation is interrupted on the other holes when they have reached the proper diameter.

In accordance with the invention, the self-limiting capability is accomplished by utilizing a pressure differential across a meniscus of the etchant extending across each hole in the substrate or web of material in which the holes are being placed and correlating it with the surface tension property of the etchant to either extract the etchant from the hole when the correct size is reached, or to block the etchant from the criticial part of the hole when the proper diameter has been reached.

Figure 3:
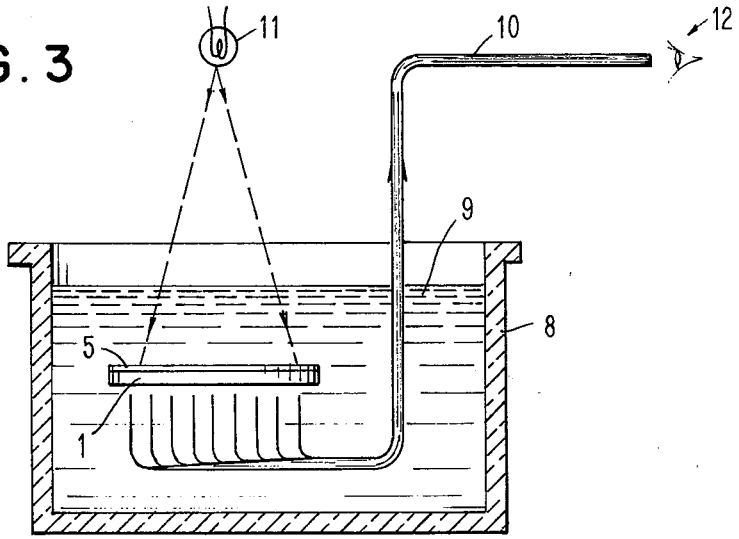
FIG. 3 is an illustration of a generalized technique for placing initial small holes in a wafer.

While depressions in the substrate to contain the etchant are sufficient, one apparatus for providing an initial array of pilot holes in the substrate or web of material corresponding to the holes in the final array, is shown in connection with FIG. 3. In FIG. 3 the substrate or web of material 1 is provided with a mask such as 5 in FIG. 1, having holes at the proper spacing. The substrate 1 is immersed in a container 8 of etchant 9 capable of etching a hole through the web 1 in the openings in the mask 5. A fiber optic bundle 10 is provided wherein each member of the fiber optic bundle is positioned beneath the substrate 1 at a point to coincide with the opening to be placed in the substrate 1 by the etchant when it etches through the substrate 1. A light 11 is provided such that the presence of the light 11 would be observed through the fiber optics at a viewing point 12 through the bundle 10 as soon as the etchant passes all the way through the substrate 1. At this point the substrate 1 will now have one or a plurality of holes properly positioned but for reasons typical of those discussed in FIGS. 1 and 2, the holes will have minor variations in diameter of opening.

In accordance with the invention, the substrate with the array of holes having the minor variations in diameter may now be uniformly etched with a self-limiting etch method employing an interdependent relationship between the surface tension of the etching solution and the pressure differential across a meniscus of the etchant residing in the hole in the substrate so that each hole is etched to a certain diameter and when that diameter is reached, the conditions of the etching operation stop the etch at that point while permitting the etch to continue until all holes have reached the same diameter.

Figure 4:
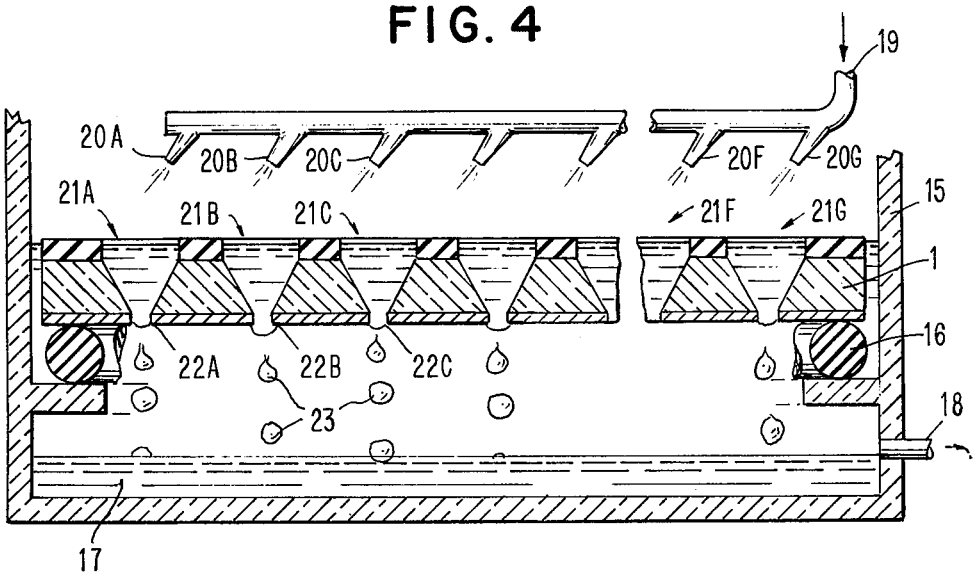
FIG. 4 is a cross-sectional view of a schematic apparatus for providing a pressure differential and a controlled amount of etchant in each of the holes in the array.

Referring to FIG. 4, an illustration is provided of the considerations involved in one approach to accomplishing the invention. In FIG. 4 a container 15 is provided having provision for mounting the substrate 1 therein. The substrate 1 is mounted on a support 16 so that etching fluid 17 can flow through holes in the substrate 1 to a reservoir below. A port 18 is used to supply a differential pressure. A source of etchant is introduced through tube 19 which is provided with ports 20A–G which introduce etchant into the pilot holes 21A–G, to a level such that there is provided in each hole 13 a reservoir level of etchant. A pressure differential is next applied through port 18 so that etchant is drawn in the direction of the hole openings 22A–G.

The etching solution considerations are that it should wet the substrate and exhibit some flexibility in surface tension parameters without radically altering the concentration. Etchants may typically be chosen from such solutions as KOH, NAOH and HF.

The pressure differential may be caused by a gas pressure or acceleration forces such as gravity.

The etchant will be retained in the hole due to surface tension and then under the influence of the pressure differential the etchant will be drawn partly through the smaller hole opening. The etchant then proceeds to react with the substrate and to open the openings 22A–G. When the opening reaches the proper size, the etchant is drawn out of the hole by the differential pressure and falls as drops 23, thereby depleting the reservoir of etchant and the hole opening stops. It will be apparent that in any instance where the etchant has not yet made a hole to the proper size, the etching will continue until the hole opening reaches the proper size at which point surface tension can no longer retain the etchant in the opening.

Referring next to FIG. 5. In order to assist in the practise of the invention some details of the relationship between the pressure differential and the surface tension of the liquid etchant are provided.

FIG. 5A is a typical configuration of a liquid in a tapered hole.

FIG. 5B is a configuration of a small hole under differential pressure and FIG. 5C is a configuration after the hole has been etched just before the etchant drops away.

The illustrations of FIGS. 5A, 5B and 5C are based upon the fact that for a given value of etching solution having a surface tension for which the symbol $\gamma$ will be used, and which in the hole with the contact angle $\theta$ and for a pressure difference illustrated as $\Delta P$ across the wafer of thickness h to be etched, there will be a critical dimension identified by the symbol $a_2$ for the exit orifice.

This relationship will remain true for any particular shape of the opening, be it square or circular. At that critical dimension, the etching solution will fall through the exit orifice and drop off the wafer in accordance with the magnitude of $\Delta P$.

Referring to FIG. 5A. Initially the etchant liquid in the hole will be retained by surface tension.

Referring next to FIG. 5B, there is indicated the portion of the liquid etchant under pressure differential, the symbol h which refers to the thickness of the wafer in which the hole is to be made, the sketch indicating a center line to the center of the hole. The angle $\theta$ is the angle formed by the etching solution with the side of the hole. $r_1$ is the radius of the meniscus of the fluid in the hole and $r_2$ is the radius of the meniscus of the fluid protruding from the hole but being retained in the hole by etchant surface tension, $a_1$ is the diameter of the hole at the upper opening and $a_2$ being the diameter of the hole at the bottom which will be the critical dimension. $P_1$ is the pressure above the liquid, P is the pressure in the liquid and $P_2$ is the pressure below the liquid. V is the volume of the liquid.

In principle, the calculation approximates the shape of the cavity to be a truncated cone. For such a structure the meniscus of the etching solutions will be portions of spheres with radii $r_1$ and $r_2$. The influence of gravity is small at these dimensions and the predominate mechanism is via the pressure differential.

In a typical calculation, referring to FIG. 5B which involves the coincidence of two equilibria as expressed by equations 1 and 2.

$$P_1 - P = 2\gamma/r_1 \qquad \text{Equation 1.}$$

$$P_2 - P = 2\gamma/r_2 \qquad \text{Equation 2.}$$

Initially $P_1 = P_2$ and hence $r_1 - r_2$ as shown in FIG. 5A. For a given $\Delta P$, which is $P_1 - P_2$, the configuration changes to that of FIG. 5B and finally to that of FIG. 5C. All the while V, the volume of etchant, is constant and equal to its initial value. At the moment of breakoff the drop is pendant as shown in FIG. 5C. The drop becomes pendant and separates from the wafer when the opening size $a_2$ becomes critical. This critical size depends on $\theta$, and is marginally sensitive to h.

Figure 6:
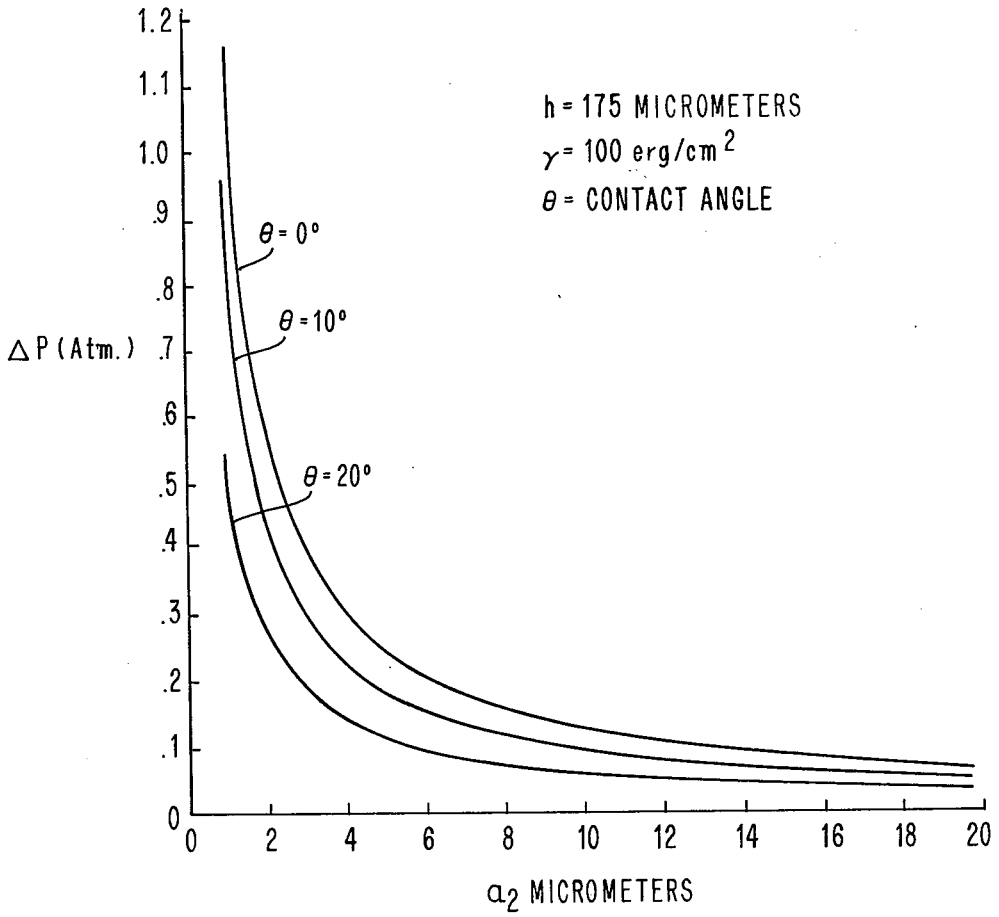
FIG. 6 is a graph describing the conditions of the diameter of the hole versus increased and differential pressure.

Referring next to FIG. 6, a graph is shown in which a number of computations are provided for various angles of $\theta$, of $\Delta P$ and of $a_2$.

Figure 7B:
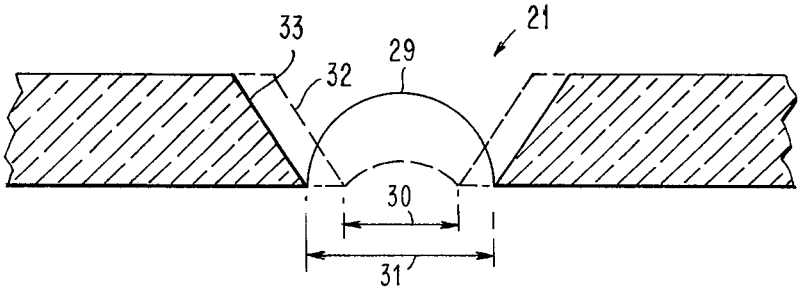
FIGS. 7A and 7B are an alternate technique of practising the invention involving the use of a gas bubble to control the diameter of the etched hole.
Figure 7A:
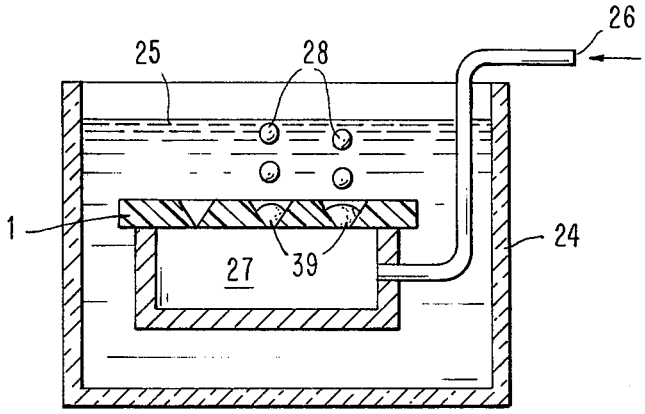

An alternate method of practising the invention is shown in connection with FIGS. 7A and 7B.

Referring to FIG. 7A, a container 24 is shown having the substrate 1 with the holes in it positioned under the level of an etchant fluid 25 and a gas introduced through a pipe 26 into a chamber 27 below the substrate. In this situation the gas operates when the diameter of the hole reaches the proper size, to form a bubble 39 and thereby to stop the etching.

FIG. 7B shows the method. A wafer containing a partially etched array is shown immersed in a bath of etchant which again attacks the sides 32, shown dotted, of the hole 21. The etchant is kept away from the lower side of the wafer, which is under a gas pressure P. If all the holes have effective radii r, less than the critical value $2\gamma/P$, where $\gamma$ is the surface tension of the etchant, then concave menisci will be formed at the lower sides of the holes. Etching of the surfaces proceeds normally, increasing the size of the opening from the diameter 30 until the effective radius reaches the critical value of $2\gamma/P$. At this point, the meniscus 29 becomes able to expand without limit into the nozzle cavity, and a bubble is formed. The bubble will expand to fill the cavity and then extend into the liquid, remaining attached to the top surface of the wafer for a time. Eventually, the bubble will grow big enough to detach itself from the wafer, leaving a smaller bubble trapped within the nozzle cavity. Although there may be some backflow of etchant into the cavity at this point, it will not reach the critically-dimensioned small end of the hole 31, which thus ceases to be etched. Thus, the hole is enlarged to its final shape 33 by etching until the effective radius reaches the value $2\gamma/P$. Other holes on the same wafer which may not yet have reached the correct size will not be affected by the bubbling through those which have, and so all holes can be brought to the correct size (controlled by the gas pressure) simply by continuing etching long enough.

For a small circular hole and zero contact angle between liquid and solid, the effective radius is simply the real radius at the small end of the hole. For a non-circular hole, such as a square, the effective radius is somewhere between that of the inscribed and circumscribed circles, but in any case is a geometrical constant which can be determined. A non-square rectangular hole will have an effective radius which tends towards that of the inscribed circle, which radius is ½ the minor dimension of the hole.

The opening size is fixed by the ratio of gas pressure P to etchant surface tension $\gamma$. Thus, control of size is obtained by fixing this ratio. However, in a production environment, while gas pressure can be held to close tolerances, a composition and contamination sensitive property, such as surface tension, is not as easy to control. Fortunately, the gas pressure can be controlled to follow variations in surface tension by measuring the pressure required to blow bubbles through a standard orifice and thus the ratio may be recontrolled.

What has been described is a technique of providing an etched array of very fine holes in a substrate member through the interdependent use of the surface tension of the etchant combined with a pressure differential across the wafer to introduce into the etching operation a self-limiting aspect which produces accurately sized holes in every instance.

Having described the invention, what is claimed as new and what is desired to secure by Letters Patent is:

1. In the fabrication of one or more holes passing through a substrate, each hole having at least one specific dimension intended to be closely controlled by the technique of etching said substrate with an etching agent having a meniscus extending across the hole, the improvement comprising:

providing an interdependent relationship between the force on said meniscus and the surface tension of a fluid, said relationship being operable to terminate etching by removal of etchant from each hole when the hole is etched to said particular dimension.

2. The process of claim 1 wherein said relationship operates to cause the fluid to drain out of the hole when the proper size is reached.

3. The process of claim 1 wherein said relationship operates to force a gas through the hole when the proper size is reached.

4. The process of etching holes that pass through a substrate so as to provide each with the same specific cross-sectional dimension comprising in combination the steps of:

maintaining in each hole a quantity of an etchant solution having a particular value of surface tension operable to govern contact of said etchant with the sides of said hole, and providing pressure differential conditions across said substrate operable to overcome said surface tension and produce removal of said etchant in each hole at said same specific cross-sectional dimension.

5. The process of claim 4 wherein said pressured differential operates to permit the etchant to run out of each hole.

6. The process of claim 4 wherein said pressure differential operates to force a gas through each hole at said same specific dimension displacing said etchant.

* * * * *